United States Patent [19]

Martinez

[11] Patent Number: 5,031,375

[45] Date of Patent: Jul. 16, 1991

[54] ANCHORING PLATE FOR JOINING PREFABRICATED INSULATION PANELS

[75] Inventor: Joaquin L. Martinez, Pamplona, Spain

[73] Assignee: Perfil en Frio, S.A., Spain

[21] Appl. No.: 499,052

[22] Filed: Mar. 26, 1990

[30] Foreign Application Priority Data

Jul. 25, 1989 [ES] Spain ..... 8902435[U]

[51] Int. Cl.[5] ..... E04B 5/52

[52] U.S. Cl. ..... 52/584; 52/461

[58] Field of Search ..... 52/459–471, 52/584, 373–396

[56] References Cited

U.S. PATENT DOCUMENTS 2,020,502 11/1935 Goddard ..... 52/461

4,435,935 3/1984 Larrea ..... 52/461

FOREIGN PATENT DOCUMENTS 590074 7/1947 United Kingdom ..... 52/466

*Primary Examiner*—James L. Ridgill, Jr.

*Attorney, Agent, or Firm*—Lucas & Just

[57] ABSTRACT

Anchoring plate for joining prefabricated insulation panels, which presents a cross-section and longitudinal section which has an inverted "U" shaped wide core and short flanges slightly inclined with regard to the core and which rest in said channels, and which presents several orifices lined-up lengthwise and centered in the core, with an anchoring solution(s) going through at least one of the orifices to attach the unit to the structure, going through one of the panels.

2 Claims, 1 Drawing Sheet

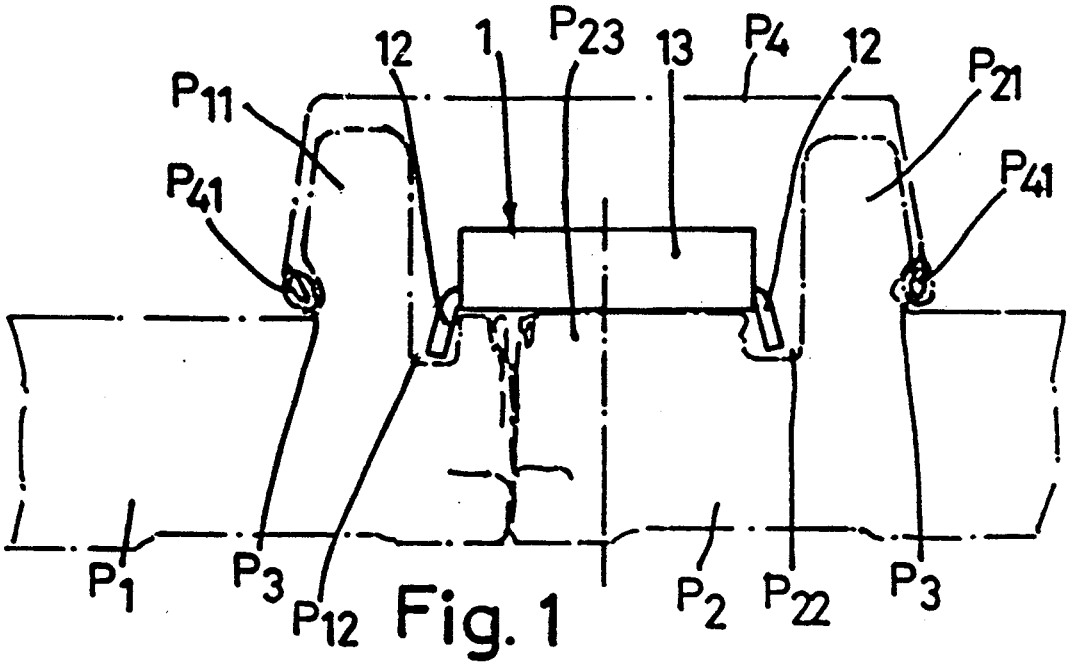
Fig. 1
Fig. 3
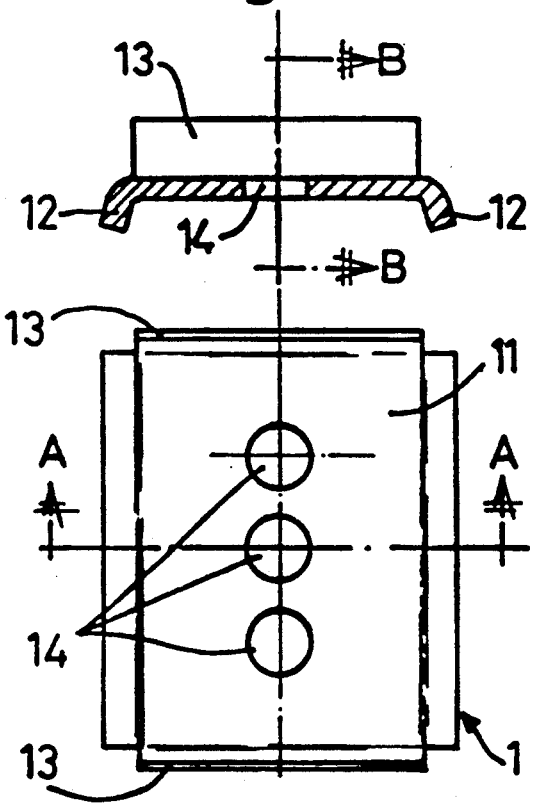
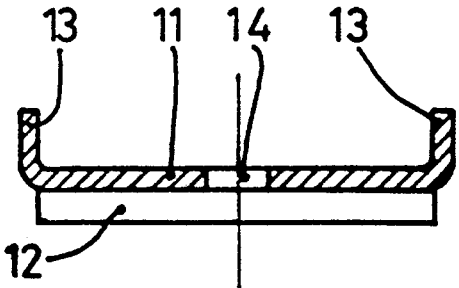
Fig. 4
Fig. 2

ANCHORING PLATE FOR JOINING PREFABRICATED INSULATION PANELS

The present invention refers to an anchoring plate for joining prefabricated insulation panels, of the type consisting of two plates, generally metallic, between which a fill-in material is placed, which has thermal-acoustical insulation, characteristics.

This type of joint is asymmetrical and in which:

one of the panels has a rib followed by a channel on one of its sides, very close to the edge;

the other has a rib followed by a channel on one of its sides, separated from the edge by a flat area.

The anchoring plate, subject of the invention, is placed in said channels, and an anchoring solution passes through the unit to affix it to a structure.

In addition, and in the working position, said plate is hidden from the outside by a joint cover which fits in the panels contours by applying pressure, thus hiding the ribs and the anchoring plate from the outside.

Each one of said channels in the panel is an elongated cavity which occupies all or part of the panel width. The anchoring parts may be of different lengths (constantly maintaining the width), as long as the panel's total width is not exceeded, (inserting one or several, according to the needs), without this altering the model's essence.

The anchoring plate, according to the invention, is characterized because:

(a) its cross-section presents an inverted "U" shape with a wide core and short flange slightly inclined with regard to the core and these rest in said channels;

(b) it presents orifices lined-up lengthwise and centered in the core, and through at least one of them the anchoring solutions(s) fixes the unit to the structure, going through one of the panels;

(c) it presents a longitudinal section which is "U"-shaped, with a wide core and short flange which contributes to said core's rigidity in the working position.

FIG. 1 represents an elevated view of an anchoring plate, in accordance with the invention, incorporated in a joint between prefabricated insulation panels.

This figure represents a layout of the panels (p1), (p2), joint cover (1) and the other parts of the joint.

FIG. 2 represents a plane view of the plate (1) corresponding to the previous figure.

FIG. 3 represents a section of the plate (1), according to indication A:A in FIG. 2.

FIG. 4 represents a section of the plate (1), according to indication B:B, in FIG. 3.

The anchoring piece (1) according to the invention, is applicable to the prefabricated insulation panels (p1), (p2) which consist of two plates between which a fill-in material with thermal-acoustical insulation characteristics is placed. This fill-in material is held in place laterally by means of a sealing gasket.

These panels (p1), (p2), have an asymmetrical joining edge.

One of these panels (p2) has a rib (p21) followed by a channel (p22) separated from the joining edge between panels (p1), (p2) by a flat area (p23).

The other panel (p1) has a rib (p11) followed by a channel (p12), very close to the joining edge between panels (p1), (p2).

Each panel (p1), (p2) also has a contour (p3) for mounting a joint cover (p4) which hides the ribs (p11), (p22) and the anchoring piece (1) from the outside.

According to the invention, and in accordance with the unit represented, the anchoring piece (1) is a single body, with an inverted "U" cross-section, with a very wide core (11) and short flanges (12), and with a slight incline with regard to the core. Said flanges (12) rest in the channels (p11), (p22), facing one side of the panels (p1), (p2).

In the longitudinal section, the anchoring piece (1) presents a wide "U" shape core (11), and short flanges (13), which emerge from said core (11) strengthening the plate unit (1) in the working position.

A number of orifices (14) are lined-up lengthwise and centered in the core (11) of said plate (1). Anchoring solutions (bushing screws) are inserted in at least one of said orifices (14) to hold the unit to the corresponding structure.

With this construction, the plate (1) mounting takes place in the following manner:

the panels are lined-up (p1), (p2).

the anchoring piece (1) is inserted, with its flanges resting in the channels (p12), (p22);

the unit is attached to a structure —not shown—using the anchoring solutions—preferable bushing screws—lined up and going through the anchoring piece (1)—through one or several of the orifices (14)—and one of the panels (p2), which previously had orifices made and with said orifices lined-up;

The unit isolated from the outside by placing joint cover (4) whose shape (p41) rests in the contour (p3) forseen in panels (p1), (p2).

I claim:

1. In an anchoring plate for joining prefabricated insulation panels wherein each of the panels to be joined has a rib extending outwardly from an exterior face of the panel and a channel extending inwardly from the exterior face of the panel, the channel being situated between the edge of the panel and the rib, the channel in one of the panels to be joined being situated close to the edge of the panel, and the channel in the other panel to be joined situated such that there is a flat area between the edge of the panel and the channel, the panels to be joined when their edges are placed together such that their respective ribs and channels all face in the same direction, and the anchoring plate being adapted to be insertable in the channels of the panels, the improvement comprising:

(a) the anchoring plate having a wide core and a first set of flanges extending outwardly in an inclined manner away from the core, which flanges are adapted to rest in the channels of the panels;

(b) the anchoring plate having a plurality of orifices in the core which are centered in the core parallel to the first set of flanges, the orifices being adapted such that at least one anchoring means can go through one of the orifices and through one of the panels in order to secure the anchoring plate to the panel; and (c) the anchoring plate also having a second set of flanges of sufficient strength so as to prevent the plate from bending, the second set of flanges being on the opposite sides of the plate than the first set of flanges and extending outwardly from the plate in a direction opposite that of the first set of flanges.

2. In a system for joining panels having an anchoring plate for joining prefabricated insulation panels wherein each of the panels to be joined has a rib extending outwardly from an exterior face of the panel and a channel extending inwardly from the exterior face of the panel, the channel being situated between the edge of the panel and the rib, the channel in one of the panels to be joined being situated close to the edge of the panel such that there is a small flat area between the edge and the channel, and the channel in the other panel to be joined being situated such that there is a large flat area between the edge of the panel and the channel, the panels to be joined when their edges are placed together such that their respective ribs and channels all face the same direction, and the anchoring plate being adapted to be insertable in the channel of the panels, the improvement comprising:

(a) the rib of each panel extending outwardly a substantial distance from the panel and having an indentation at the base of the rib on the side away from the edge of the panel;

(b) the flat area of each panel being aligned with the face of the panel such that the depth of the panel is the same except at the rib and the channel;

(c) the anchoring plate having a wide core and a first set of flanges extending outwardly in an inclined manner away from the core, the flanges being adapted to rest in the channels of the panels;

(d) the anchoring plate having a plurality of orifices in the core which are centered in the core parallel to the first set of flanges, the orifices being adapted such that at least one anchored means can go through one of the orifices and through one of the panels in order to secure the anchoring plate to the panel;

(e) the anchoring plate also having a second set of flanges of sufficient strength so as to prevent the plate from bending, the second set of flanges being on the opposite sides of the plate than the first set of flanges and extending outwardly from the plate in a direction opposite that of the first set of flanges; and (f) a joint cover having securing means so as to fit into the indentations in each of the ribs and cover the ribs, the channels, and the anchoring plate.

* * * * *